US005685326A

United States Patent [19]

Cord et al.

[11] Patent Number: 5,685,326

[45] Date of Patent: Nov. 11, 1997

[54] OSCILLATOR SCREEN CLEANING APPARATUS AND METHOD

[75] Inventors: Albert B. Cord; Cameron W. Cord, both of Cincinnati, Ohio; David N. Gehrich, St. Paul, Ind.; Gregory N. Jensen, Westchester; Ted K. Parr, Cincinnati, both of Ohio

[73] Assignee: Intercontinental Chemical Corporation, Cincinnati, Ohio

[21] Appl. No.: 547,654

[22] Filed: Oct. 24, 1995

[51] Int. Cl.[6] ..... B08B 3/02

[52] U.S. Cl. ..... 134/63; 134/148; 134/153; 134/157; 134/165

[58] Field of Search ..... 134/63, 83, 104.3, 134/109, 111, 125, 131, 144, 148, 151, 153, 155, 157, 164, 165, 191; 354/325, 326

[56] References Cited

U.S. PATENT DOCUMENTS

| | | | |
|---|---|---|---|
| 2,131,406 | 9/1938 | Mosmieri et al. | 134/165 X |
| 2,682,213 | 6/1954 | Shapiro | 134/151 X |
| 3,343,555 | 9/1967 | Kasner | 134/191 X |
| 3,405,720 | 10/1968 | Carlson | 134/148 X |
| 3,580,261 | 5/1971 | Key | 134/148 X |
| 3,656,493 | 4/1972 | Black et al. | 134/113 |
| 3,930,879 | 1/1976 | Ericson et al. | 134/109 X |
| 4,420,004 | 12/1983 | Jensen | 134/96 |
| 4,561,903 | 12/1985 | Blaul | 134/10 |
| 4,664,721 | 5/1987 | Valasek | 134/26 |
| 4,717,426 | 1/1988 | Brynildsen | 134/26 |
| 4,739,780 | 4/1988 | Czaja et al. | 134/131 X |
| 4,808,237 | 2/1989 | McCormick et al. | 134/26 |
| 4,826,539 | 5/1989 | Harpold | 134/10 |
| 4,865,061 | 9/1989 | Fowler et al. | 134/109 X |
| 5,197,384 | 3/1993 | Yawata et al. | 101/123 |
| 5,206,970 | 5/1993 | Johnson | 15/321 |
| 5,220,933 | 6/1993 | Albers | 134/191 X |
| 5,372,153 | 12/1994 | Dodson | 134/165 X |

FOREIGN PATENT DOCUMENTS

| | | |
|---|---|---|
| 0057966 | 8/1982 | European Pat. Off. . |
| 3017180 | 11/1981 | Germany . |
| 58-132562 | 8/1983 | Japan . |
| WO 9005065 | 5/1990 | WIPO . |
| WO 9115370 | 10/1991 | WIPO . |
| WOUS9624492 | 8/1996 | WIPO . |

OTHER PUBLICATIONS

Patent Abstract of Japan—JP.A.58 132562 Nov. 1983

Advertising for Perfecta 'S' XP002006526.

*Primary Examiner*—Philip R. Coe

*Attorney, Agent, or Firm*—Wood, Herron & Evans, L.L.P.

[57] ABSTRACT

An oscillator screen cleaning apparatus includes an enclosed housing which forms a cleaning chamber having a plurality of spray nozzles to spray a printing screen. An oscillating mechanism moves the screen in an oscillating motion in front of the spray nozzles for efficient and effective cleaning. Fixed guide brackets extend into the cleaning chamber from the spray nozzles to guide a screen and maintain the screen perpendicular to the spray patterns from the nozzles. The guide brackets will readily guide screens of different widths and heights without requiring constant adaptation. A reservoir is integrated with the enclosed cleaning chamber and a sloped wall captures spray from the cleaning chamber and directs it to the reservoir for recycling. A vertically oriented pump in the reservoir directs cleaning liquid to the spray nozzles and any failure of the pump is contained in the reservoir to prevent leakage. A wipe down booth is coupled to the cleaning chamber and captures excess cleaning liquid after the screen is removed from the cleaning chamber and directs to the captured liquid back into the reservoir.

18 Claims, 5 Drawing Sheets

OSCILLATOR SCREEN CLEANING APPARATUS AND METHOD

RELATED APPLICATION

This application is related to application Ser. No. 08/384,737, filed Feb. 7, 1995, and now U.S. Pat. No. 5,566,697, which is incorporated herein in its entirety by reference.

FIELD OF THE INVENTION

This invention relates generally to screen printing and specifically to apparatuses and methods for cleaning printing ink and other materials from printing screens and frames used in screen printing.

BACKGROUND OF THE INVENTION

Screen printing, also known as serigraphics, is the process of transferring an image to a substrate by the use of a printing screen through which ink is squeezed. The ink is then deposited in all places on the substrate except where the screen has been processed by a photographically applied image depicting the places where ink is not to be forced through the screen mesh. The imaged screen mesh is normally made of silk, plastic or metal and is held in place by a screen frame made of wood, plastic or metal. The ink contains pigment or dye in an appropriate vehicle.

Screen cleaning requires the removal of all ink residue from the screen and frame when the printing is completed. Methods currently utilized to clean printing screens involve spraying the screen with pressurized solvent from a nozzle or gun structure. Many spraying techniques, however, result in overspray which directs solvent where it is not desired thereby wasting solvent and increasing the costs and inefficiency of the procedure. Additionally, spray cleaning methods usually require the use of paid workers thus raising the costs of cleaning and also exposing the workers to the solvent and solvent fumes.

Several attempts have been made to develop a cleaning procedure and apparatus which eliminates the various drawbacks of the above-mentioned procedures. For example, U.S. Pat. No. 3,580,261 discloses a printing screen cleaner which utilizes two vertically oriented lines of nozzles which oppose each other inside a cleaning enclosure. A screen is passed on a conveyer belt through the opposing nozzle lines whereupon it is sprayed with pressurized solvent. While eliminating several of the drawbacks of the above-discussed existing methods, the cleaner has other drawbacks which prevent the efficient and effective cleaning of a printing screen. Specifically, it utilizes only two opposing lines of spray nozzles within the enclosure and, therefore, each area of the screen is sprayed only once as the screen passes through the opposing nozzle lines. The screen is generally not adequately cleaned when the cleaning cycle has been completed and, therefore, the screen must be taken and passed through the cleaner additional times for additional cleaning cycles until it is sufficiently clean. As may be appreciated, such a task is time consuming and costly, and requires continuous worker supervision of the cleaning machine. For example, the work involves handling the screen by insertion into the machine, removal and manual brush agitation, then reinsertion, to insure adequate cleaning. Therefore, the cleaner disclosed in the '261 patent is not very efficient or cost effective.

The screen washing apparatus of U.S. Pat. No. 3,656,493 utilizes an enclosure and a single spray nozzle which is directed over the screen by a control mechanism to spray a predetermined pattern. Specifically, the nozzle sweeps horizontally in one direction across the screen to an end position and is then ratcheted down a few rows of the screen whereupon it sweeps in the opposite direction to an opposite end position and is ratcheted down to begin the process again. The nozzle continuously sweeps and ratchets until it reaches a bottom position which is pre-set by an operator. The screen is swept only once by the nozzle and if any portions remain dirty, the operator must remove the nozzle and manually spray the screen. Furthermore, the single nozzle only sprays a small area of the screen at any given time. Again, such a screen washing apparatus is neither efficient nor cost effective because the cleaning process has to be monitored to ensure that the single sweep was sufficient to remove the printing ink and the screen must be manually sprayed if the single sweep was not sufficient. Furthermore, the gun is controlled with manual presets which must be adapted to spray a particular screen size, and insertion of a different size screen into the washing apparatus requires additional programming of the spray pattern of the device, thus further reducing the efficiency and cost effectiveness of the apparatus. Additionally, the operator is exposed to solvent fumes whenever it is necessary to manually direct the gun to completely clean the screen.

The screen cleaning apparatus of U.S. Pat. No. 4,420,004 utilizes a single row of adjacent nozzles which moves horizontally with respect to a screen to spray the screen and remove the printing ink as well as the stencil or print pattern. The single row of spray nozzles requires a continuous back and forth sweeping motion of the nozzle row which must be repeated until the screen is adequately cleaned. Since there is only a single line of nozzles, only a small area of the screen is sprayed at any one time leaving the remaining area unsprayed until the nozzle line again passes over that area. This increases the time that is required to adequately clean the screen because when one small area of the screen is being sprayed, the remaining area of the screen is dormant. As a result, the cleaning cycle of the apparatus in the '004 patent is inefficient and, therefore, not cost effective.

The related application Ser. No. 08/384,737 entitle Oscillator Screen Cleaning Apparatus discloses an inventive cleaning apparatus which addresses various of the shortcomings of the prior art and provides an oscillating cleaning apparatus and methods which rapidly and efficiently clean a printing screen and frame. Little or no supervision by operators is necessary with the oscillator cleaning apparatus, thereby making the apparatus very cost effective. The apparatus catches and reuses the sprayed solvent for further cost savings. There is still a need in that art for screen cleaning apparatuses which are versatile, reliable and low-cost, and which provide superior cleaning without taking up a large amount of valuable floor space.

Various currently available screen cleaning apparatuses utilize a variety of different integrated systems which must be operably coupled together for proper screen cleaning. Such apparatuses also utilize numerous adjustable or movable parts or elements that must be constantly maintained or replaced. The various separate systems coupled together for cleaning, as well as the various movable parts increases the overall manufacturing and operating costs of the cleaning apparatus.

For example, existing apparatuses include elements or sections which must be constantly adjusted to wash screens of different sizes. While the apparatuses will wash short screens and tall screens or narrow screens and wide screens, they must constantly be adapted for each different screen size. As may be appreciated, necessity of adjusting the apparatuses for different size screens requires manual attention, and therefore, increases labor and operating costs. Additionally, the various adjustable mechanisms associated with such systems are more expensive to manufacture thus increasing the manufacturing costs in addition to the increased operating costs.

Furthermore, the different integrated systems of the cleaning apparatuses include coupling and connecting points and associated seals which are subject to wear and failure. For example, the various fluid lines, valves, pumps and seals interconnected between the liquid supply and the cleaning chamber present potential points of leakage. In addition to the mess and waste associated with such leakage, the leakage may also pose environmental concerns. The maintenance or replacement of the various separate system components further increases the overall costs associated with each cleaning apparatus. Still further, the various separate and integrated systems increase the overall size of the cleaning apparatus and take up valuable floor space.

Cleaning liquid or solvent waste is also a problem with some currently available systems because the screens and the frames often retain a certain amount of solvent when removed from the cleaning apparatus. Such excess solvent usually drips off of or is shaken from the screens and falls to the floor to be discarded or to evaporate. Therefore, solvent is constantly being removed from the system and must be periodically replenished at an increased cost to the operator of the apparatus. The operator is also exposed to the excess solvent.

Accordingly, and in view of the above background, there is a need for a screen cleaning apparatus which is versatile, durable, reliable and which may be manufactured and subsequently used at a relatively low cost. Specifically, it is desirable to provide a screen cleaning apparatus that does not have to be repeatedly customized for different size screens. Furthermore, it is desirable for such a screen cleaning apparatus to utilize a minimum number of physically separated systems which must be operably coupled to the apparatus to thereby reduce the number of connection points and possible leaking or failure points in the system. It would also be highly desirable to reduce the necessary maintenance of the system while maintaining the desirable cleaning aspects. It is a further objective of the invention to reduce the overall size of the screen cleaning apparatus to efficiently utilize valuable floor space.

It is still a further objective to reduce waste associated with excess cleaning solvent which clings to the screen and frame and is discarded when it is removed from the cleaning apparatus.

SUMMARY OF THE INVENTION

This invention solves the problems associated with known apparatuses and methods for cleaning screens. The method and apparatus of this invention also satisfy the aforementioned needs that exist in the art as developed in the background of this invention.

The screen cleaning apparatus of the present invention includes an enclosed housing which forms a cleaning chamber for receiving a printing screen and a plurality of spray nozzles positioned inside the cleaning chamber to spray the screen with a cleaning solvent or other cleaning liquid. An oscillating mechanism is mounted within the cleaning chamber and moves the screen in an oscillating motion within the chamber in front of the spray nozzles. The oscillating movement and the plurality of spray nozzles yields repeated and increased screen coverage with sprayed cleaning liquid to provide improved cleaning and removal of undesired printing inks and other contaminants from the screen and surrounding frame in a single cleaning cycle.

The oscillator screen cleaning apparatus of the present invention utilizes two opposing pluralities of spray nozzles wherein the individual nozzles of each plurality are arranged in opposing grid patterns at horizontally and vertically spaced-apart nozzle positions. The screen is oscillated back and forth between the opposing nozzle pluralities preferably in approximately 8–10 inch cycles, and the grid patterns provide increased screen coverage with the sprayed cleaning liquid or solvent. As the screen is oscillated, the entire screen area is constantly being sprayed with solvent. The opposing grids of spray nozzles are operable to deliver sprayed cleaning solvent to a screen at a rate, for example, of about 60 to about 215 gallons per minute, depending on the machine size, to effectively clean the screen.

Opposing pluralities of fixed guide brackets are mounted to the pluralities of spray nozzles to provide guidance to the screen as it is oscillated. The opposing guide brackets define a narrow path therebetween and also between the spray nozzles for passage of the screen. The guide brackets maintain the screens generally perpendicular to the spray patterns or streams from the nozzles for effective cleaning. The brackets are mounted at an angle to the spray nozzles so as not to interfere with the spray from the nozzles. In accordance with the principles of the present invention, the guide brackets support the screen from the side and thereby do not restrict the screen from the top frame edge. Versatility is increased because screens of various different sizes may be readily sprayed with the apparatus without constantly customizing the cleaning chamber. Since the brackets are essentially fixed, assembly of various moving parts is not necessary, thus reducing manufacturing costs and the labor costs associated with adapting the apparatus for different screen sizes. The fixed brackets are also more durable, requiring very little or no maintenance or repair.

A reservoir is positioned proximate the spray nozzles and is integrated with the cleaning chamber to hold the cleaning liquid which is sprayed on the screen. The reservoir also holds recaptured cleaning liquid falling from the screen. Particularly, the integral reservoir includes a sloping wall or tray positioned directly beneath the spray nozzles and oscillating screen to catch the used cleaning liquid which drips therefrom. The integral sloping wall directs the used liquid into the reservoir and eliminates the need to pump recaptured liquid from a separate tank. The integral reservoir thus reduces necessary piping and leakage associated with the piping.

A vertically-oriented pump is coupled between the reservoir and the nozzles and pumps the cleaning solvent to the nozzles to thereby constantly cycle and recycle the solvent. A portion of the pump is mounted inside of the reservoir such that the cleaning liquid is pumped directly from the reservoir to the spray nozzles. The internal pump of the invention reduces the number of exposed fluid lines, valves and seals which, in turn, prevents leaks associated with failure of one of the lines, valves or seals. Additionally, the internal pump prevents any leaks which may occur as a result of a failure of the pump seal. A line, valve or seal leakage is directed back into the reservoir.

The pump is preferably a higher capacity pump, and the high recirculation of the cleaning solvent provided by the pump keeps the ink particles suspended in the solvent to prevent the reservoir from becoming clogged with ink sludge which would reduce its effectiveness. In addition, a reservoir which is kept clean requires less maintenance. A filter coupled between the pump and the spray nozzles removes filterable particles from the recycled cleaning fluid. A dump valve in the line between the pump and spray nozzles provides guide drainage of the system into the reservoir. The supply reservoir which holds the recycled cleaning solvent may also be connected to a decantation drum which receives used solvent from the reservoir and holds the solvent for settling of the suspended contaminants and subsequent decanting of the cleaning solvent for re-use. The cleaning apparatus is enclosed in a housing to prevent the cleaning solvent and solvent fumes from entering the atmosphere or area adjacent the cleaning apparatus. Further, a vapor recovery system is coupled to the housing to remove vaporized cleaning solvent and to control odor associated with the cleaning procedure.

The oscillating mechanism moves the screen in an oscillating motion having a period of motion in the range of about 3 to about 20 inches, and preferably around 8–10 inches. The mechanism operates to move the screen in a complete cycle of the oscillating motion approximately 20 times per minute. The continuous oscillation of the screen in combination with the opposing grids of spray nozzles and the guidance of the screens by the guide brackets generally perpendicular to the nozzles provides repeated application of the spray pattern onto the screen for excellent cleaning coverage. Furthermore, during the entire cleaning cycle of the oscillator screen cleaning apparatus of the present invention, each area of the screen is continually being directly sprayed resulting in a faster more efficient cleaning period which does not have to be continually repeated as required with other known screen cleaning apparatuses. The present invention thus provides rapid cleaning of ink and other printing materials from a printing screen and surrounding frame with the attainment of very clean screens and screen frames.

As may be appreciated, the screen is sprayed repeatedly during a cleaning period using the present invention and when the period has ended, the screen and any associated frame member will contain a significant amount of excess cleaning fluid. The invention further comprises a wipe down booth positioned proximate an open end of the enclosed housing. A screen is manually transferred to the wipe down booth after it is cleaned and excess cleaning liquid is removed, such as by a cloth or a squeegee. The wipe down booth is configured to capture the excess cleaning liquid from the screen. The wipe down booth includes a sloped floor and is operably coupled to the enclosed housing such that any excess cleaning liquid removed from the screen is directed into the housing and subsequently into the reservoir. In that way, excess cleaning liquid is not wasted when the screen is removed from the enclosed cleaning chamber.

The advantages of the apparatus include a high impingement spraying system to improve ink removal; full screen and frame cleaning through oscillating motion; a low maintenance integral reservoir tank to contain and recapture the cleaning liquid; a vertical pump contained within the integral reservoir to further contain the cleaning liquid and prevent leaks and spills; high volume/low maintenance filter system to reduce nozzle maintenance; quick drain system to empty risers of product which decreases cycle time (no need to wait for nozzles to stop spraying); air curtain venting system to reduce operator exposure to fumes; fixed guide brackets for guiding various differently sized screens without requiring constant adaptation; and a wipe down booth which captures excess cleaning liquid after the screen is cleaned and directs the excess liquid to the reservoir and adjustable stop guide for varying screen sizes.

The above and other objects and advantages of the present invention shall be made apparent from the accompanying drawings and the description thereof.

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
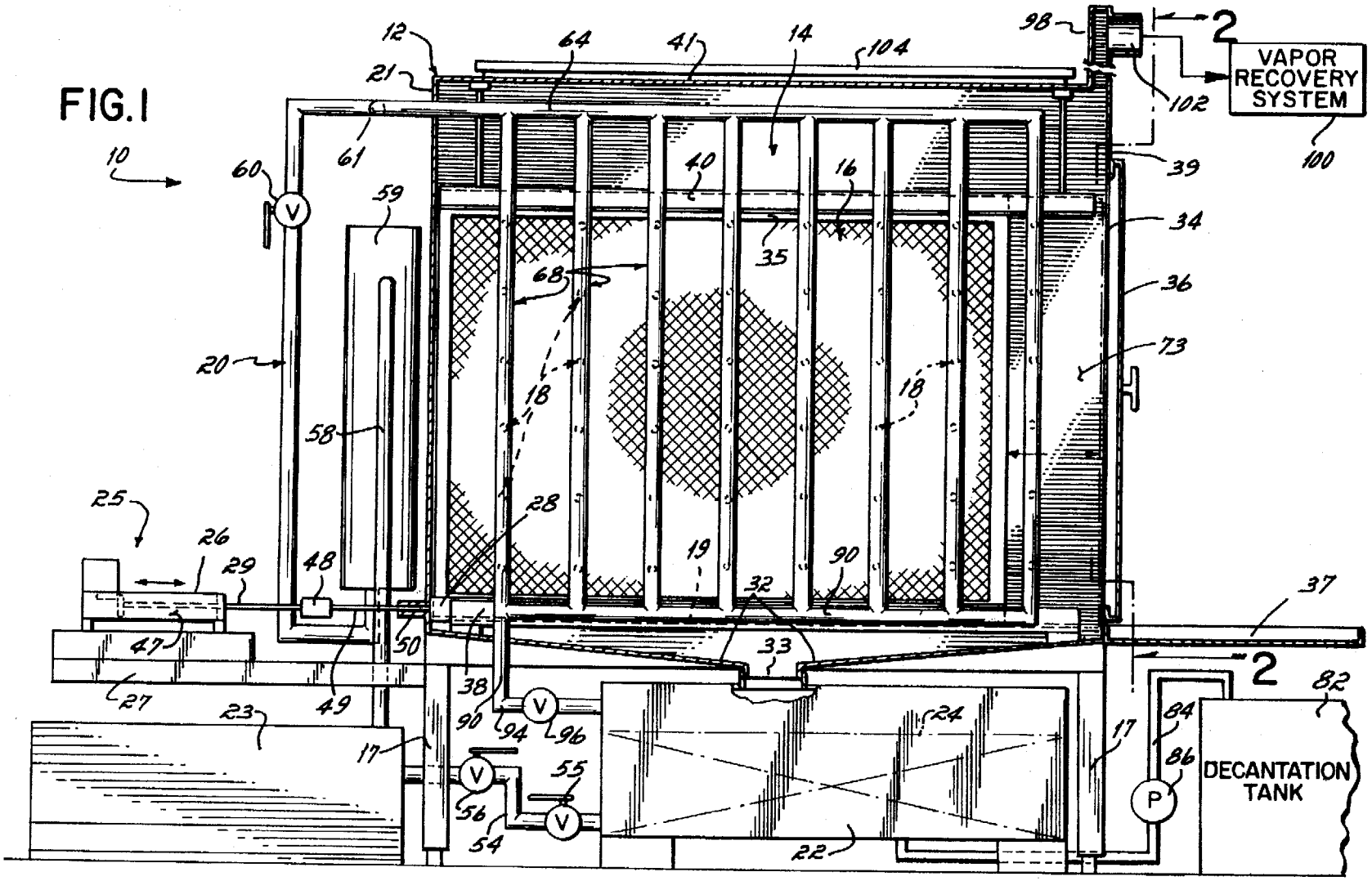
FIG. 1 is a side view, in partial cross-section, of an embodiment of the oscillator screen cleaning apparatus of the present invention.
Figure 2:
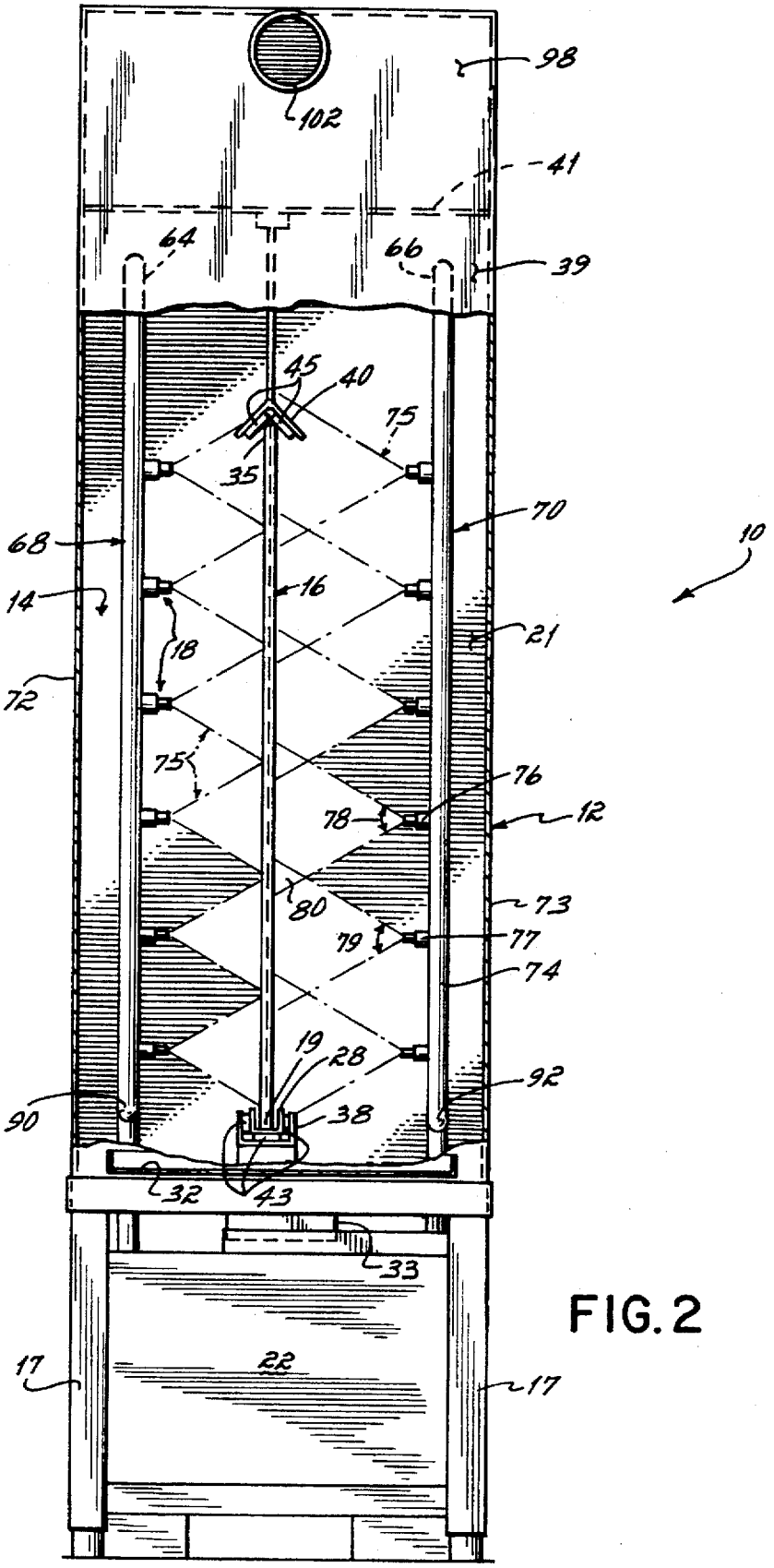
FIG. 2 is an end view of the embodiment of the present invention shown in FIG. 1 taken along lines 2—2 of FIG. 1.

One embodiment of the oscillator screen cleaning apparatus 10 of the present invention as illustrated in FIG. 1 includes an enclosed housing 12 which forms a cleaning chamber 14 therein for receiving a printing screen 16 (See FIG. 2). Housing 12 is preferably formed of fourteen gauge stainless steel and is supported above a floor surface by legs 17. A plurality of spray nozzles 18 are connected, via a supply line 20, to a reservoir 22 containing an amount of cleaning solvent or cleaning liquid 24. Suitable cleaning compositions are disclosed in U.S. Pat. No. 4,664,721, and components of those compositions may also be used as cleaning liquids, and such disclosures are incorporated herein by reference. The cleaning solvent 24 is pumped from reservoir 22 by pump 23 through line 20 to nozzles 18 which spray the screen 16 with solvent to remove printing inks or dyes from the screen 16 so that the screen may be re-used.

While screen 16 is being sprayed, an oscillating mechanism 25 moves screen 16 back and forth within chamber 14 in front of the spray nozzles 18 to more effectively and more efficiently clean the screen. Oscillating mechanism 25 comprises a push-pull device 26, which is connected to a movable track 28 which holds and supports screen 16 at a bottom edge 19 of the screen (See FIG. 2). The push-pull device 26 is mounted on a support platform 27 which extends from the rear end 21 of housing 12, and push-pull device 26 includes an actuatable plunger 29 which extends in a longitudinal direction with respect to housing 12. The plunger 29 of push-pull device 26 is coupled to track 28, and when the push-pull device 26 is actuated, the plunger slides the track 28 and screen 16 lengthwise back and forth inside housing 12 in an oscillating motion. The oscillating movement provided by oscillating mechanism 26 ensures that the plurality of spray nozzles 18 repeatedly cover all areas of the screen 16 with sprayed cleaning solvent 24.

Preferably, and as discussed in greater detail below, the plurality of nozzles 18 are arranged in two separate grid patterns one on each side of the cleaning chamber 14 to spray both sides of screen 16 simultaneously. This provides improved cleaning and removal of undesired printing inks and other contaminants from the screen 16. The floor 32 of housing 12 is sloped to form a funnel-shaped surface so that used sprayed cleaning solution or solvent, which drips from the sprayed screen 16, fails against floor 32 and is drained into reservoir 22 through a drain opening 33. The collected solvent may then be pumped again back through line 20 and nozzles 18 to be resprayed against screen 16. In this way, the cleaning solvent 24 is re-used repeatedly rather than wasted, thus resulting in substantial cost savings. The high capacity spray capability of the present invention ensures effective cleaning of screen 16 with the re-used spray as will be discussed in greater detail below.

To clean a printing screen 16, the screen is placed into housing 12 and cleaning chamber 14 through an access opening 34 formed in one end of housing 12. Access opening 34 is covered by a hinged door 36 or some similar closure to completely seal the cleaning chamber 14 within housing 12. A drip pan 37 extends outwardly from the front end 39 of housing 12 beneath access opening 34 to catch cleaning solvent which drips from the screen 16 when it is removed from the cleaning chamber 14 after it has been sprayed and cleaned. This prevents cleaning solution or solvent 24 from being spilled on the floor surface and entering the environment. Inside the cleaning chamber 14, the bottom edge 19 of screen 16 is placed onto a movable track 28 which is moved back and forth or oscillated by push-pull device 26 of the oscillating mechanism 25. Track 28 moves within a larger channel 38 and specifically slides lengthwise in channel 38. Channel 38 is mounted longitudinally within housing 12 to support track 28 and screen 16 above the sloped floor 32 of housing 12. A layer 43 of a low friction material, such as ultra high molecular density polyethylene (UHMDPE) is inserted between track 28 and channel 38 to ensure smooth movement and oscillation of track 28 within channel 38. As shown in FIG. 2, a top edge 35 of screen 16 engages a guide channel 40 which is suspended from a top wall 41 of the housing 12. The guide channel 40 ensures that the screen 16 is held generally vertically between the opposing grids of spray nozzles 18 for more effective cleaning of the screen. Guide channel 40 also preferably includes a layer 45 of the low friction UHMDPE to ensure smooth movement of screen edge 39 along the guide channel 40.

The oscillating mechanism 25 moves track 28 within channel 38 and oscillates screen 16 back and forth in front of the opposing grids of spray nozzles 18. As mentioned, the oscillating mechanism 25 includes a push-pull device 26 such as a pneumatically operated solenoid. Other mechanically oscillating devices might also be utilized in place of push-pull device 26. The device 26 is shown on the outside of the body 47, but also may be mounted on the inside. The plunger 29 of the push-pull device 26 moves longitudinally in a straight direction inside a body 47 of the push-pull device 26 when the device is actuated, such as by pressurized air. The plunger 29 is coupled through a coupling fixture 48 to an arm 49 which is fixed at one end to track 28. Arm 49 extends into housing 12 through a liquid seal 50 which guides arm 49 to ensure a smooth, straight and generally longitudinal movement of arm 49 and track 28 inside the cleaning chamber 14. The liquid seal 50 protects from loss of cleaning liquid through hole in housing 12. When the push-pull mechanism 26 is actuated, plunger 29 moves back and forth thereby pulling and pushing track 28 and oscillating screen 16 between the spray nozzles 18.

Generally, push-pull device 26 of the present invention and arm 49 should be dimensioned to provide a range or period of motion of from about 3 to about 20" and preferably around 10". That is, it has been determined that movement of screen 16 approximately 10" in a forward motion and then 10" in a rearward motion in accordance with the principles of the present invention provides excellent cleaning. However, greater or lesser periods of motion might be utilized. Further, it has been determined that an oscillator frequency of approximately 20 cycles per minute for the oscillating mechanism 25 of the present invention is a sufficient oscillating motion to provide an efficient and effective screen cleaning. A single cycle of the oscillating mechanism 26 involves moving the track 28 the full range or period of the motion, e.g., 10", and then back again. Of course, a faster or slower oscillation frequency may be utilized as appropriate to sufficiently clean screen 16.

The oscillator screen cleaning mechanism of the present invention will now be described in greater detail with respect to its operation and the delivery of the sprayed cleaning solution or solvent 24 to the screen 16. Specifically, a cleaning liquid or cleaning solvent 24 is placed in reservoir 22 which may be made of stainless steel and preferably has a capacity of, for example around 55 gallons, depending upon the size of the machine. A suitable cleaning solvent for cleaning printing screen 16 in accordance with the teachings of the present invention is disclosed in U.S. Pat. No. 4,664,721. However, the oscillator screen washing apparatus 10 of the present invention is not limited to the use of a particular solvent, and other appropriate solvents might be placed within reservoir 22.

When the oscillator screen cleaning apparatus 10 is actuated, the solvent is pumped through the supply line 20 by pump 23. Pump 23 is preferably a high capacity pump, to deliver, for example, about 60 to about 215 gallons per minute, depending on machine size as stated above. A short section 54 of supply line 20 connects reservoir 22 and pump 23 and includes manual valves 55 and 56 which may be closed to prohibit solvent 24 from exiting reservoir 22 or draining back from pump 23, respectively, such as when it is desirable to remove reservoir 22 for maintenance.

When valves 55, 56 are open, the pump 23 pumps solvent 24 through line section 54 and up through a filter line section 58 into a filter unit 59. Filter unit 59 removes foreign particles and contaminants within the cleaning solvent 24 in line 20 before the solvent 24 is delivered to the spray nozzles 18. A suitable filter for such a purpose is the 50 micron bag filter which removes different materials such as tape, mesh, adhesive, dry ink and stencil particles. Filter unit 59 allows the solvent 24 to be continually re-used to spray screen 16. As mentioned above, the re-use of the solvent 24 amounts to a substantial cost savings, because the used solvent may be collected and filtered rather than continually replaced with new solvent. After the solvent is filtered, it is directed through line 20 to the spray nozzles 18. A valve 60 is connected in the supply line 20 and may be closed to prevent liquid 24 in line 20 from back flowing into filter 59 during filter maintenance.

The supply line 20 branches at a point along its length, such as point 61, to direct cleaning solvent to the spray nozzles 18 on both sides of the cleaning chamber. Specifically, as shown in FIG. 2, the solvent is directed into supply branches 64, 66 located proximate the top of the cleaning chamber 14. The branches 64, 66, in turn, feed into pluralities of vertically extending finger lines 68, 70, respectively, which are coupled to their respective supply branches 64, 66 and extend generally vertically from the top of the cleaning chamber 14 to the bottom of the cleaning chamber. Referring now to FIG. 2, branch 64 feeds the first plurality of finger lines 68 while branch 66 feeds a second plurality of finger lines 70. Each vertical finger line contains a plurality of spray nozzles 18 arranged in a generally straight vertical line thereon. The nozzles 18 are vertically spaced apart along the lengths of each finger line. The individual finger lines of the pluralities 68, 70 are horizontally spaced apart one from the other and extend generally parallel with each other from their respective supply branches. The finger lines of each plurality 68, 70 are also generally co-planar with each other such that each plurality of finger lines 68, 70 defines a spraying plane of nozzles 18 as illustrated in FIG. 2. The spraying planes of nozzles 18 are generally vertically oriented and are parallel the side walls, such as side walls 72, 73, of the housing 12. The combination of the horizontally spaced apart finger lines 68, 70 and the vertically spaced apart nozzles 18 creates opposing grids of spray nozzles 18 within cleaning chamber 14. The opposing grids of spray nozzles ensures that, while screen 16 is oscillated within the cleaning chamber 14, the entire screen area is constantly being sprayed with cleaning solvent 24 to effectively and efficiently clean the screen.

Referring again to FIG. 2, each nozzle 18 forms a generally V-shaped flat spray pattern 75 on screen 16. Cleaning solvent impingement created by nozzles helps remove ink and dye residue. The flat spray pattern 75 is vertically oriented so that the horizontal oscillating motion provided by oscillating mechanism 25 moves the screen 16 perpendicular to the flat spray pattern of each nozzle 18. The nozzles 18 of each finger line, such as finger line 74, are spaced along the finger line 74 to provide pattern overlap of the spray patterns. For example, nozzles 76 and 77 of finger line 74 provide flat spray patterns 78, 79, respectively. The nozzles 76, 77 are spaced such that their spray patterns overlap at area 80. The overlapping spray patterns ensure complete coverage of screen 16 with the sprayed solvent. A nozzle suitable for use within the present invention yields a spray pattern approximately ten inches wide.

The oscillator screen cleaning apparatus of the present invention is capable of delivering a high quantity of sprayed cleaning solvent to screen 16 during a cleaning cycle. Specifically, the spraying system of the present invention, including high capacity pump 23 and the opposing grids of spray nozzles 18, is operable to deliver sprayed cleaning solvent to the screen 16 at a rate in the range of about 60 to about 215 gallons per minute. The high solvent delivery rate and the continual coverage over the area of the screen in combination with the oscillating screen motion of the present invention yields a very efficient cleaning cycle.

As discussed above, the cleaning solvent 24 is continually filtered and re-used within the oscillator screen cleaning apparatus of the present invention. Specifically, the cleaning solvent 24 sprayed onto screen 16 by nozzles 18 drips from the screen and falls onto the sloped floor 32 of housing 12 where it is directed through drain opening 33 back into reservoir 22. The used solvent is again pumped through line 20 and filter unit 59 to be directed to the grids of spray nozzles 18. As discussed, continual re-use of the cleaning solvent yields substantial cost savings and the high spray capacity and suspension of ink particles within the solvent ensures that the re-used cleaning solvent effectively cleans screen 16.

After several cleaning cycles, the used solvent within reservoir 24 may need to be recycled. To do so, the used solvent may be transferred to a decantation tank either manually or through a line and pump coupled to the reservoir 22. Referring now to FIG. 1, in one embodiment of the present invention, decantation tank 82 is coupled to reservoir 22 through line 84 and pump 86. The used cleaning solvent is pumped into the decantation tank 82 wherein the ink and other contaminant particles which are suspended in the solvent are allowed to settle. The decanted solvent may then be removed from tank 82 and transferred back into reservoir 22 for additional use within the oscillator screen cleaning apparatus 10.

The spraying system of the oscillator screen cleaning apparatus 10 of the present invention is configured to be quickly drained when desired such as for decantation and recycling of the cleaning solvent 24. Specifically, referring to FIG. 1, each finger line of the finger line pluralities 68, 70 terminates in a respective draining branch 90, 92. The draining branches 90, 92 extend generally parallel to the respective supply branches 64, 66, respectively, and receive any solvent which is not sprayed through the nozzles 18. The draining branches 90, 92 beneath the cleaning chamber 14 converge at point 94 and are connected through a dump valve 96 into reservoir 22. When the dump valve 96 is actuated, either manually or pneumatically, the entire system including supply branches 64, 66 and finger lines 68, 70, is drained of cleaning fluid in approximately 5 seconds. This provides rapid draining of fingers to decrease cycle time and to reduce vapors in chamber.

Housing 12 completely encloses the finger lines 68, 70 and spray nozzles 18 to ensure that all of the cleaning solvent 24 is contained within cleaning chamber 14 and that little or none of the solvent escapes into the atmosphere or the environment around the oscillator screen cleaning apparatus 10. This provides a safer, healthier environment for personal working near the cleaning apparatus 10. Further, the housing 12 has a flue 98 formed in the top thereof which is coupled to a vapor recovery system 100 through an opening 102 in flue 98. The vapor recovery system ensures that vaporized solvent from cleaning chamber 14 does not escape into the atmosphere to be breathed in by workers, thereby further creating a more healthy work environment. A removable cover 104 on the top wall 41 of housing 12 allows access to the cleaning chamber 14 from above.

Figure 3:
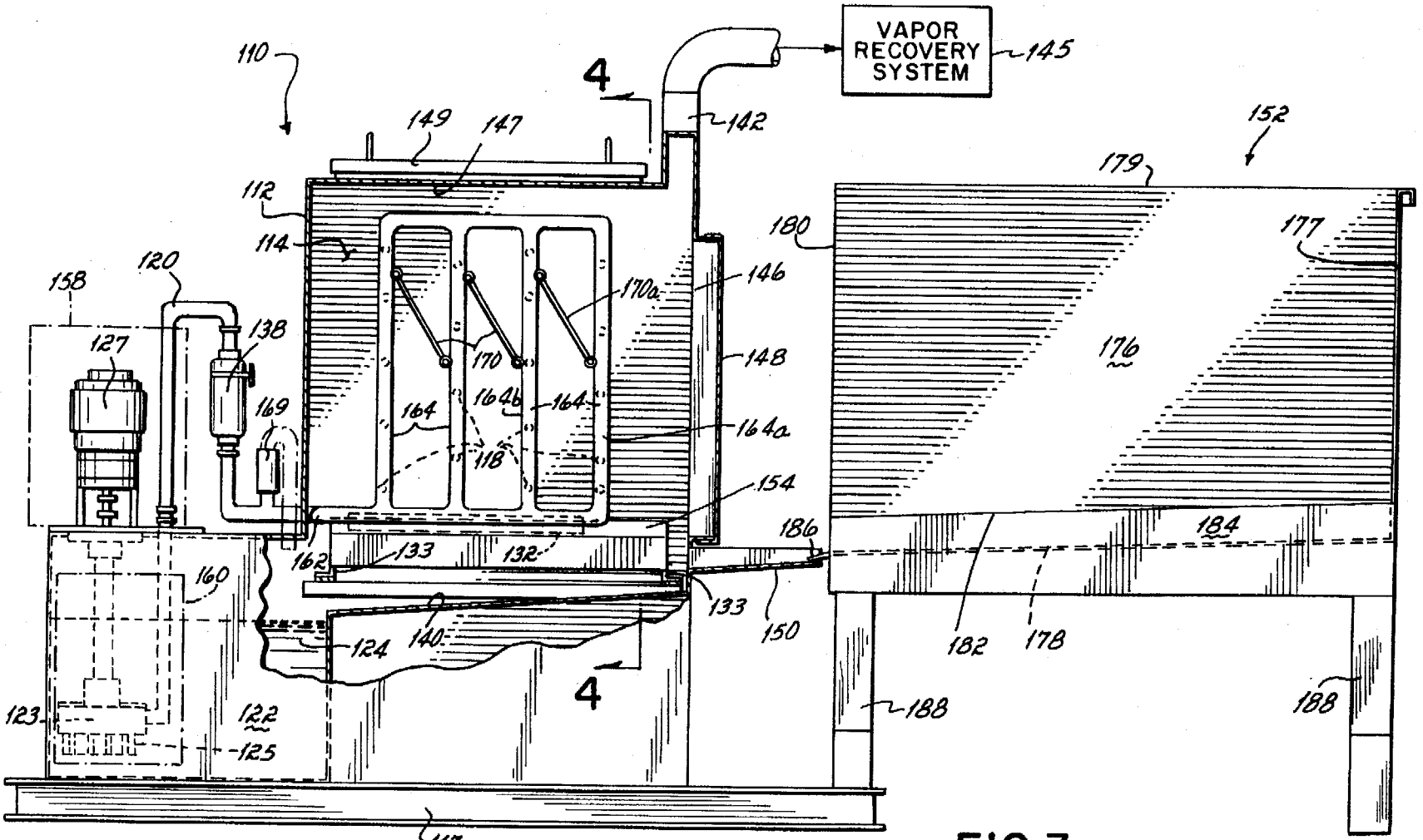
FIG. 3 is a side view in partial cross section of another embodiment of an oscillator screen cleaning apparatus in accordance with the principles of the present invention.

FIGS. 3, 4, 5 and 6 illustrate another embodiment of an oscillator screen cleaning apparatus. The oscillator screen cleaning apparatus 110 of the present invention as illustrated in FIG. 3 includes an enclosed housing 112 which forms a cleaning chamber 114 therein for receiving a printing screen 116 (see FIG. 4.) Housing 112 is supported above the floor surface by a skid 117. Skid 117 provides easy mobility of the cleaning apparatus 110. A plurality of spray nozzles 118 are connected via a supply line 120 to a reservoir 122 containing an amount of cleaning solvent or cleaning liquid 124. Suitable cleaning compositions are disclosed and discussed hereinabove. The cleaning liquid 124 is pumped from the reservoir 122 to the supply line 120 and the nozzles 118 buy a vertically oriented pump 123. Pump 123 includes an intake end 125 which is operably coupled to a motor 127 for drawing liquid through the intake end 125 and pumping it to the nozzles 118 to be sprayed therefrom.

Figure 6:
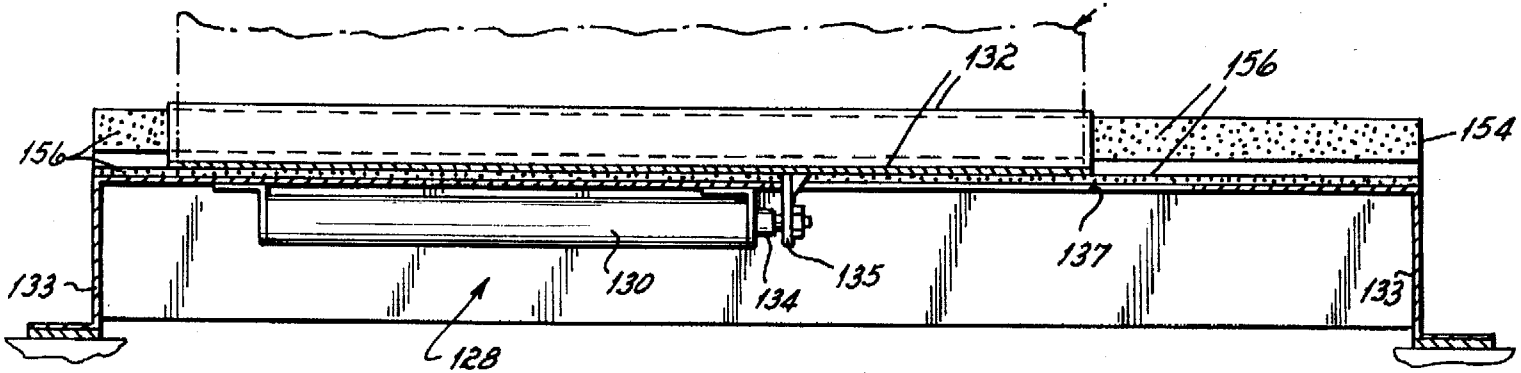
FIG. 6 is a cross-sectional view along lines 6—6 of FIG. 4 to illustrate the oscillating mechanism of the embodiment of FIG. 3.

In accordance with the principles of the invention, an oscillating mechanism 128 is coupled to the chamber 114 for moving screen 116 back and forth within the chamber in front of the spray nozzles 118 to more effectively and efficiently clean the screen (see FIG. 6). Referring to FIG. 6, the oscillating mechanism 128 comprises a push-pull device 130, such as a pneumatically operated cylinder, which is connected to a movable track 132 that supports the screen 116 at a bottom edge thereof. The push-pull device 130 is mounted to a support structure 133 which extends below the spray nozzles 118 in chamber 114. Push-pull device 130 includes an actuatable plunger 134 which is coupled to a tang 135 which depends downwardly from track 132. When the push-pull device 130 is actuated, plunger 134 moves back and forth and slides the track 132 lengthwise inside the cleaning chamber 114 in an oscillating motion. An appropriate slot 137 is formed in the support structure 133 to achieve movement of the tang 135 on track 132. Preferably, opening 137 is dimensioned to allow an oscillating stroke or cycle of approximately 8–10 inches. As discussed above, the oscillating movement of the screen insures that the plurality of spray nozzles 118 repeatedly cover all areas of the screen 116 with sprayed cleaning liquid 124.

Referring to FIG. 3, the plurality of nozzles 118 are preferably arranged in two separate grid patterns, one on each side of the cleaning chamber 114, to spray both sides of the screen 116 simultaneously. The cleaning liquid 124 is pumped by pump 123 through the supply line 120 and through a filter 138 before it is sent through the nozzles 118. The filter is preferably a 50 micron bag filter which removes different materials such as tape, mesh, adhesive, dry ink and stencil particles to allow the cleaning liquid to be continually reused in the invention.

To capture the sprayed cleaning liquid for reuse, the reservoir 122 includes an integrally formed sloping wall 140 which is positioned below cleaning chamber 114 to capture the sprayed cleaning liquid which drips from the screen and subsequently direct the captured liquid into reservoir 122. As illustrated in FIG. 3, the housing 112 integrally forms both the reservoir 124, the cleaning chamber 114 and the sloping wall 140. In that way, the entire system is enclosed to prevent loss of cleaning liquid and further to control fumes and odors and to reduce exposure of an operator to the cleaning liquid. Any fumes in cleaning chamber 114 are directed through an outlet 142 which is preferably coupled to a vapor recovery system 145 or other venting system. A top opening 147 covered by lid 149 provides access to the cleaning chamber, such as for maintenance.

In accordance with the principles of the present invention, the cleaning liquid is contained so that it may be reused and the prevention of cleaning liquid loss amounts to a cost savings for the operator of the invention. The integration of the reservoir tank 122 with the cleaning chamber 114 eliminates the need for a separate reservoir tank which must then be coupled to pump 123 through various supply lines, valves and seals which are subject to failure and leakage. Therefore, the integral reservoir 122 and chamber 114 of the present invention eliminates leakage and waste associated with the various valves and seals.

Additional linkage and waste is reduced by the vertically oriented pump 123 which is mounted inside of the reservoir 122. The internal pump having its intake end 125 positioned in the reservoir 122 eliminates the need for an external pump and thereby generally eliminates any leakage from the system associated with the failure of a pump seal or other pump components. Any leakage from the pump will be contained within the reservoir 122 until the pump or seal can be repaired, The combination of the integrally formed reservoir 122 and vertically oriented pump 123 reduces cleaning liquid loss from the system, amounting to a cost savings and further preventing operator exposure and the mess associated with such leakage. The invention also reduces labor costs associated with containing and cleaning a spill or leak.

To clean a printing screen 116 in apparatus 110, the screen is placed in the housing 112 and cleaning chamber 114 through an access opening 146 covered by a door 148 or a similar closure to completely seal the cleaning chamber 114. The cleaned screen is also removed through the access opening 146. A drip pan 150 extends outwardly from the housing beneath the access opening 146 to catch cleaning liquid which drips from the screen 116 when it is removed from the cleaning chamber 114 after it has been sprayed and cleaned. Furthermore, the drip pan 150 provides coupling to a wipe down booth 152 which further captures excess cleaning liquid from the screen and directs it to the reservoir 122 as described further hereinbelow.

Figure 4:
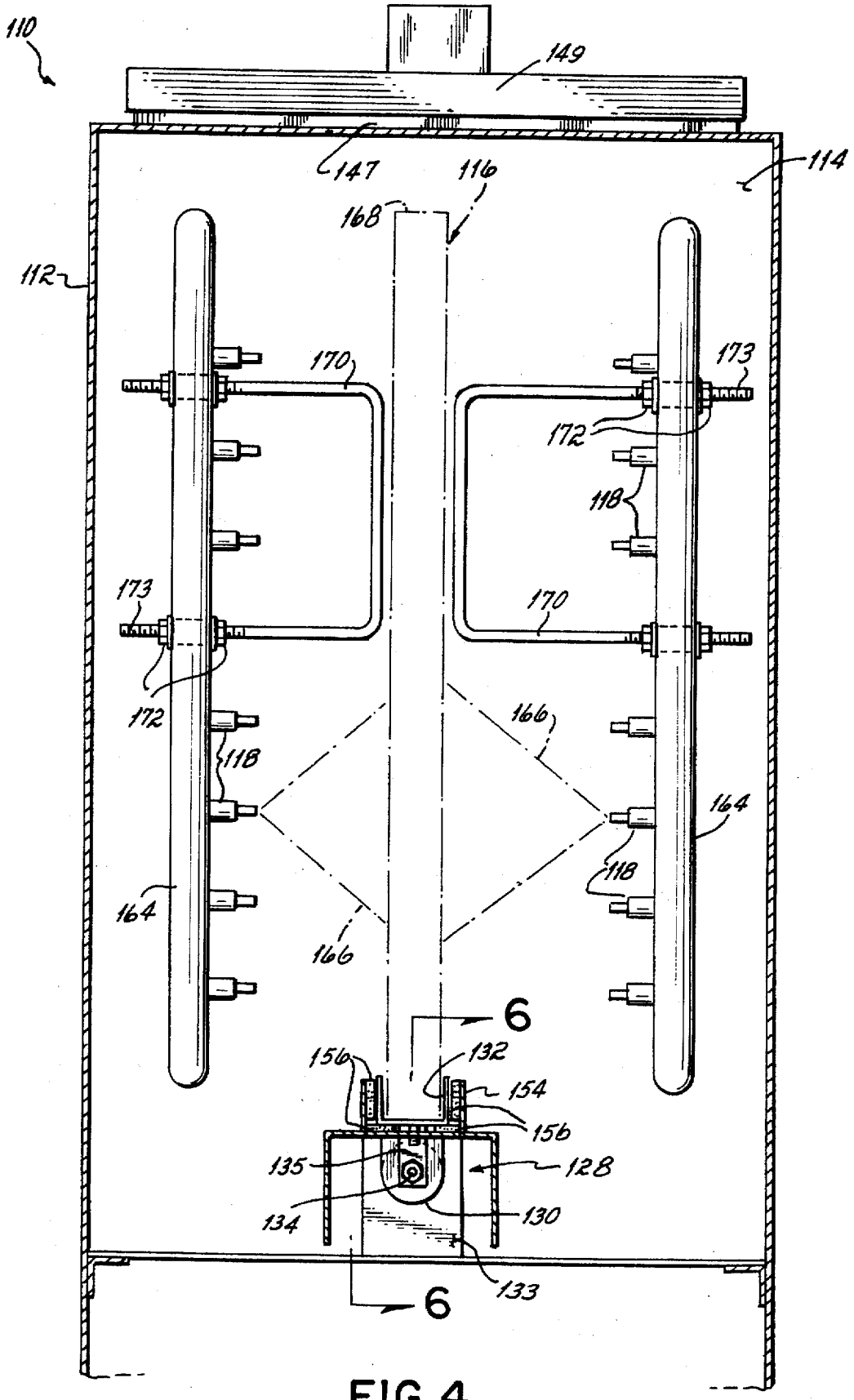
FIG. 4 is a cross-sectional view of the embodiment shown in FIG. 3 along lines 4—4 of FIG. 3.

The screen is positioned on movable track 132 to be oscillated back and forth by the oscillating mechanism 128 (see FIG. 6). Referring to FIG. 4, the movable track 132 moves or oscillates within a larger channel 154 and specifically slides lengthwise within the channel 154. Various strips of low friction material 156 such as Teflon® are positioned between the channel 154 and movable track 132 at the sides and beneath the track 132 to insure movement and oscillation of the track. The oscillating mechanism preferably moves the screen at approximately 20 cycles per minute to provide efficient and effective screen cleaning.

The oscillating mechanism 128, pump motor 127 and a dump valve 169 for draining the system are preferably coupled to appropriate electrical controls and air controls The controls are preferably be positioned above or adjacent to reservoir 122 as illustrated in phantom in FIG. 3 by an electrical control cabinet 158 and air control cabinet 160. When the oscillator screen apparatus 110 is actuated at the beginning of a cleaning cycle, the solvent 124 is pumped by pump 123 through the supply line 120. Pump 123 is preferably a high capacity pump to deliver, about 60–215 gallons per minute depending upon the requirements for the screens being cleaned. The supply line branches at point 162 to provide fluid to various riser lines or finger lines 164 which support the nozzles 118 to form opposing spray nozzle grids. The pumped fluid is directed up the riser lines 164 and through the nozzles 118 to spray both sides of the screen 116 as illustrated in FIG. 4 by the spray patterns 166. The spray patterns 166 are preferably vertically oriented and overlap vertically one with the other to provide complete coverage of screen 166. The nozzles 118 are preferably maintained generally coplanar in vertical planes within each grid by the riser lines 164. In that way, spraying planes are defined by the nozzle grids and the spray planes coincide generally in the center of the cleaning chamber 114 where the screen passes (See FIG. 4). As the screen 116 is oscillated between the spraying grids, the entire screen area is constantly sprayed with cleaning liquid 124 to effectively and efficiently clean the screen.

For effective cleaning, the screen is preferably guided between the nozzle grids generally parallel to the grids and perpendicular to the spray patterns 166. The oscillator screen cleaning apparatus 110 readily accepts screens which have different sizes. While the screen 116 is oscillated by the contact of its bottom edge with track 132, the top edge 168 of screen 116 is not engaged or otherwise restricted. In that way, screens with various heights and widths may be cleaned without constantly adapting the apparatus 110. In accordance with the principles of the invention, adjustably fixed guide brackets 170 are mounted to the various riser lines 164 of the spray nozzle grids. Referring the FIG. 4, each bracket 170 is preferably U-shaped and extends vertically with the riser lines 164 at an angle thereto (See FIG. 3). For example, guide bracket **170*a* extends at an angle between riser line 164*a* and riser line 164*b*. The brackets are angled between the riser lines 164 so as to not interfere with the spray from spray nozzles 118. The guide brackets 170 engage the sides of the screen 166 to guide it and maintain it in an upright position. Preferably, pairs of guide brackets 170 are mounted between the opposing spray nozzle grids as illustrated in FIG. 4 to cooperate and confine the screen 116 between the nozzles in a plane generally parallel with the planes of the nozzle grids. The fixed guide brackets 170 extend between each riser line 164 and thus maintain the screen in an upright vertical position while being oscillated in the cleaning chamber 114. Thereby, the screen 116 is maintained in a proper position for cleaning without restricting the screen upper edge 168. The adjustably fixed guide brackets 170 eliminate the need for constantly adjusting a guide mechanism to customize the cleaning apparatus 110 for screens of different heights and/or widths As will be appreciated, the guide brackets 170 of the invention reduce the cost of manufacturing the apparatus because they eliminate specially fabricated adjustable parts which are subject to wear and subsequent replacement. Furthermore, labor costs are reduced because an operator is not required to adjust the guide brackets 170 every time a different sized screen is being cleaned. Furthermore, the oscillating screen cleaning apparatus 110 utilizing guide brackets 170** is more durable and eliminates maintenance normally required with an adjustable screen guiding assembly.

Referring again to FIG. 4, the ends of the U-shaped guide brackets 170 are preferably threaded and are held to the riser lines 164 by nut pairs 172 which fit on a threaded portion 173 at the end of each guide bracket 170. In that way, the fixed guide brackets 170 may be adjusted inwardly or outwardly as necessary with respect to the spray nozzle grids for handling screens with different widths. It is anticipated that such adjustment will not often be necessary but is available in accordance with the principles of the present invention to adapt the apparatus to wash unusually wide screens.

Referring again to FIG. 4, each nozzle 118 forms a generally V-shaped flat spray pattern 166 which is vertically oriented so that the horizontal oscillating motion provided by oscillating mechanism 128 moves a screen 116 perpendicular to the flat spray pattern. The nozzles 118 are spaced along each riser line 164 to preferably provide pattern overlap of the spray patterns 166 for a full spray coverage of the screens. A suitable spray nozzle 118 would produce a spray pattern of approximately 10 inches wide. The cleaning solvent 124 is continually filtered and re-used within the oscillator screen cleaning apparatus 110. Specifically, a major portion of the cleaning liquid 124 sprayed onto screen 116 will drip from the screen 116 and fall onto the sloped wall 140 to be directed back into reservoir 122. While most of the liquid will drip from the screen in the cleaning chamber 114, the screen and any frame utilized therewith will usually retain a certain amount of liquid. It will be appreciated, that the surface tension of the liquid often fills the small squares of a screen and is held therein. The liquid is removed or evaporates from the screen when it is taken from the cleaning apparatus 110 and is irretrievably lost from the system thereby increasing frequency at which the cleaning fluid must be replenished and increasing the cost of operation. The present invention utilizes a wipe down booth 152 to capture and recirculate residual cleaning liquid from the screen 116 after it is removed from the cleaning chamber 114.

Figure 5:
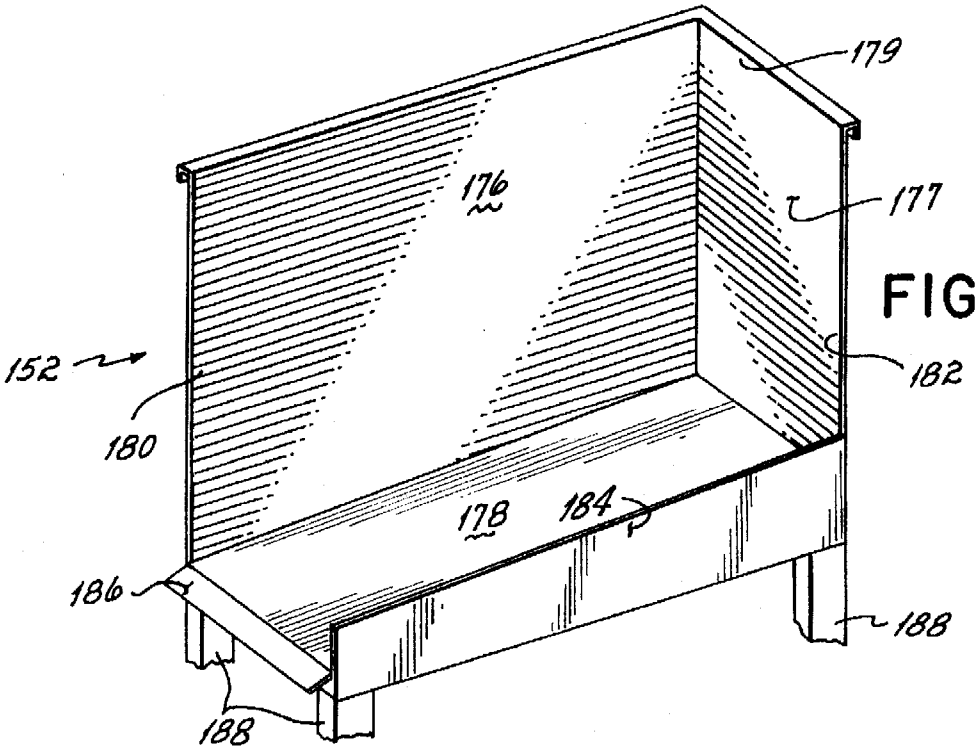
FIG. 5 is a perspective view of a wipe down booth of the embodiment shown in FIG. 3.

Referring to FIG. 5, the wipedown booth 152 comprises a back wall 176, a side wall 177, and a sloping floor 178. The top 179 of booth 152 is open as is the side 180 closest to the cleaning apparatus 110 and the front 182 of the booth. The front 182 of booth 152 includes a short wall 184, preferably 3 inches, high, which contains fluid runoff from a screen placed in the wipedown booth. The sloped floor 178 feeds to a drainage lip 186 which couples to the drip pan 150. Floor 178 slopes in the direction of the cleaning apparatus 110, and therefore any accumulated liquid flows down floor 178 to lip 166 and into drip pan 150 and subsequently to the sloping wall 140 where it is drained into reservoir 122. Booth 152 is supported on legs 188 which may be appropriately adjusted as necessary to change the height of the booth and to couple the lip 186 and drip pan 150 together for proper liquid flow.

When screen 116 is removed from the cleaning apparatus 110 through opening 146, it is immediately slid into the wipedown booth 152. Therein, the excess cleaning liquid and any residue are wiped off of the screen, such as with a squeegee, and the excess liquid drains to the reservoir 122 as previously described. The screen 116 can then be wiped off and dried, such as with a cloth. The side wall 177, back wall 176 and short front wall 184 ensure that the excess liquid is contained and appropriately drained back into the cleaning apparatus 110 and the reservoir 122. In that way, excess cleaning fluid is not wasted, resulting in greater cost saving to the operator. Furthermore, with less wasted liquid, the reservoir 122 does not have to be refilled as often.

The spray system of the oscillator screen cleaning apparatus 110 is configured to be quickly drained, such as for decantation and recycling of the cleaning liquid 124. To that end, a dump valve 169 is coupled in the supply line 120 between filter 138 and the spray nozzles 118. When the dump valve 169 is actuated, either manually or pneumatically, the entire system, including the liquid and supply line 120 and the riser lines 164 are drained directly into the reservoir 122.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An apparatus for cleaning a screen with a sprayed cleaning liquid comprising:

a housing forming a cleaning chamber for receiving a screen;

a plurality of spray nozzles positioned inside the cleaning chamber to spray, with cleaning liquid, the screen passed thereby within the chamber;

a supply reservoir coupled to the plurality of spray nozzles for supplying cleaning liquid to the spray nozzles;

an oscillating mechanism to move said screen in an oscillating motion within said cleaning chamber in front of the spray nozzles to clean the screen;

guide brackets mounted in the housing for engaging and guiding the screen during oscillation, the guide brackets operable to engage a side of the screen and leave a top edge of the screen unrestricted such that screens of different heights may be cleaned while the brackets remained fixed;

whereby screens of different sizes may be readily washed in the apparatus without attention to manual adjustments to the apparatus by an operator thereby resulting in cost savings.

2. Apparatus as in claim 1 wherein one of said brackets is coupled to the spray nozzles to guide the screen in front of the nozzles, the brackets positioned with respect to the nozzles to reduce interference with the sprayed cleaning liquid.

3. Apparatus as in claim 2 wherein the brackets are angled with respect to the nozzles.

4. Apparatus as in claim 1 wherein said nozzles are positioned on either side of the chamber to spray the screen from opposing sides, the brackets extending into the chamber between the nozzles to guide the screen generally perpendicular to the sprayed cleaning liquid from the nozzles.

5. Apparatus as in claim 4 wherein the brackets are positioned as cooperating pairs of brackets, one on either side of said chamber, a space being formed between the brackets .for passage of the screen.

6. Apparatus as in claim 5 wherein the brackets are adjustable horizontally to be moved away from each other to widen the space therebetween for accommodating screens of different widths.

7. Apparatus as in claim 1 wherein said reservoir is coupled to the cleaning chamber to catch used cleaning liquid which falls from said screen when the screen is sprayed thereby recycling the cleaning liquid.

8. Apparatus as in claim 7 wherein said reservoir is integrally formed with the cleaning chamber.

9. Apparatus as in claim 7 wherein said reservoir includes a sloped wall for catching the used cleaning liquid beneath the screen and directing the liquid to an accumulation area in the reservoir.

10. Apparatus as in claim 1 further comprising a pump coupled to the reservoir to supply the cleaning liquid to the spray nozzles, a portion of the pump positioned inside the reservoir for reduced leakage during screen cleaning.

11. Apparatus as in claim 1 further comprising a wipe down booth positioned proximate said cleaning chamber, the wipe down booth configured for receiving a cleaned screen from the chamber and capturing excess cleaning liquid dripping from the screen.

12. Apparatus as in claim 11 wherein the wipe down booth is coupled to said cleaning chamber and directs the excess cleaning liquid back into the chamber.

13. Apparatus as in claim 12 wherein the wipe down booth includes a sloping wall for directing the excess cleaning liquid back into the chamber.

14. Apparatus as in claim 11 wherein the wipe down booth is configured to allow access to an operator for removing the excess cleaning liquid from the screen.

15. An apparatus for cleaning a screen with a sprayed cleaning liquid comprising:

a housing forming a cleaning chamber for receiving a screen;

a movable track configured for receiving the screen;

a plurality of spray nozzles positioned inside the cleaning chamber to spray, with cleaning liquid, the screen passed thereby within the chamber;

a supply reservoir formed integrally with the housing and coupled to the plurality of spray nozzles for supplying cleaning liquid to the spray nozzles;

a pump coupled between the reservoir and the nozzles to pump cleaning liquid to the nozzles, a portion of the pump positioned inside the reservoir for reduced leakage during screen cleaning;

an oscillating mechanism including a push-pull device, the push-pull device coupled to the track and operable for pushing and pulling the track and moving said screen in a repeated continuous oscillating motion within said cleaning chamber to thus move the screen repeatedly back and forth in front of the spray nozzles to clean the screen.

16. Apparatus as in claim 15 further comprising fixed guide brackets mounted in the housing for engaging and guiding the screen during oscillation, the guide brackets operable to engage a side of the screen and leave a top edge of the screen unrestricted such that screens of different heights may be cleaned while the brackets remained fixed.

17. Apparatus as in claim 15 wherein the reservoir is coupled to the cleaning chamber for catching used cleaning liquid which falls from said screen when the screen is sprayed thereby recycling the cleaning liquid.

18. Apparatus as in claim 15 further comprising a wipe down booth positioned proximate said cleaning chamber, the wipe down booth configured for receiving a cleaned screen from the chamber and capturing excess cleaning liquid dripping from the screen.

* * * * *